United States Patent [19]

Stackhouse

[11] Patent Number: 4,809,884

[45] Date of Patent: Mar. 7, 1989

[54] WINE STEWARD

[76] Inventor: Wells F. Stackhouse, 124 Tamarisk Way, Leesburg, Fla. 32748

[21] Appl. No.: 107,008

[22] Filed: Oct. 13, 1987

[51] Int. Cl.[4] ..... B67D 5/42

[52] U.S. Cl. ..... 222/153; 222/95; 222/396.5; 222/484; 493/929

[58] Field of Search ..... 222/94–95, 222/105, 130, 164, 166, 386.5, 397, 399, 400.7, 479, 483–484, 153, 92; 215/231, 315; 137/38; 493/210, 212–213, 927, 929

[56] References Cited

U.S. PATENT DOCUMENTS

| | | | |
|---|---|---|---|
| 447,974 | 3/1891 | Rheinstrom | 215/269 |
| 713,708 | 11/1902 | Spire | 215/269 |
| 2,066,977 | 1/1937 | Iler | 225/22 |
| 2,286,797 | 6/1942 | Duerme | 222/386.5 |
| 2,326,641 | 8/1943 | Heeter et al. | 215/4 |
| 2,779,517 | 1/1957 | Beall, Jr. | 215/315 X |
| 2,966,282 | 12/1960 | Geisler | 222/386.5 |
| 3,343,701 | 9/1967 | Mahoney | 215/52 |
| 3,561,642 | 2/1971 | Bazarnic | 222/153 X |
| 4,159,790 | 7/1979 | Bailey | 222/386.5 X |
| 4,322,020 | 3/1982 | Stone | 222/95 |
| 4,340,054 | 7/1982 | Michaels | 128/260 |
| 4,392,578 | 7/1983 | Fipp et al. | 215/231 |
| 4,482,072 | 11/1984 | Hankins | 215/269 |
| 4,595,121 | 6/1986 | Schultz | 222/1 |
| 4,671,436 | 6/1987 | Hagan | 222/402.25 |
| 4,702,396 | 10/1987 | Gwiazda | 222/152 |
| 4,706,847 | 11/1987 | Sankey et al. | 222/1 |

FOREIGN PATENT DOCUMENTS

| | | | |
|---|---|---|---|
| 1150289 | 1/1958 | France | 222/386.5 |
| 970678 | 9/1964 | United Kingdom | 137/38 |

*Primary Examiner*—Michael S. Huppert

*Attorney, Agent, or Firm*—Bean, Kauffman & Bean

[57] ABSTRACT

A dispenser for controlling the dispensing of a liquid from a container, such as a bottle having an opening through which liquid may be poured, is provided in combination with a bladder insertable within the container and expansible incident to dispensing of liquid for occupying a volume corresponding to that of the dispensed liquid in order to prevent air contamination of any liquid remaining in the container. An improved bladder construction and method of forming same is disclosed.

5 Claims, 1 Drawing Sheet

WINE STEWARD

BACKGROUND OF THE INVENTION

The invention relates to apparatus for controlling the dispensing of a liquid from a container and more particularly to the dispensing of a liquid, such as wine, from a bottle, wherein liquid remaining in an unsealed bottle is subject to air contamination or degradation.

Conventional dispensing devices include a stopper or other seal device adapted to be removably attached to the neck of a bottle and fitted with a pour spout and an air vent device or a pump device serving to assist in the discharge of liquid through the pour spout. A drawback of this type of dispensing device is that air entering the bottle, as an incident to the dispensing of a portion of its contents, contacts and contaminates or degrades liquid remaining within the bottle.

It has also been proposed to prevent air contamination of liquid remaining in an unsealed bottle by fitting a stopper with a manually inflatable bladder sized to occupy a portion of the interior of the bottle with a view towards displacing air therefrom through a suitable vent located in the stopper. These devices suffer the drawback that they must be removed from the bottle each time liquid is to be dispensed and are thus wholly inoperative for protecting remaining contents of the bottle, while it is left standing in an open condition.

SUMMARY OF THE INVENTION

The present invention is directed towards a dispenser particularly adapted for use in the dispensing of wine from a bottle and protecting unused wine remaining in the bottle from air contamination.

The present dispenser includes a stopper or other suitable seal device for closing the mouth or pour opening of the bottle neck after same has been unsealed by removal of its permanent closure; a first passageway for placing a bladder inserted into the interior of the bottle in flow communication with a source of fluid, such as the atmosphere; a second passageway through which the contents of the bottle may be poured; manually operable flow control valves arranged in the passageways; means for normally preventing operation of the valves until the bottle is placed in an inverted or pouring position; and a check valve disposed in the second passageway for preventing the return of liquid to the interior of the bottle when same is returned to an upright position.

The invention features an inexpensively formed disposable bladder removably attachable to the stopper.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
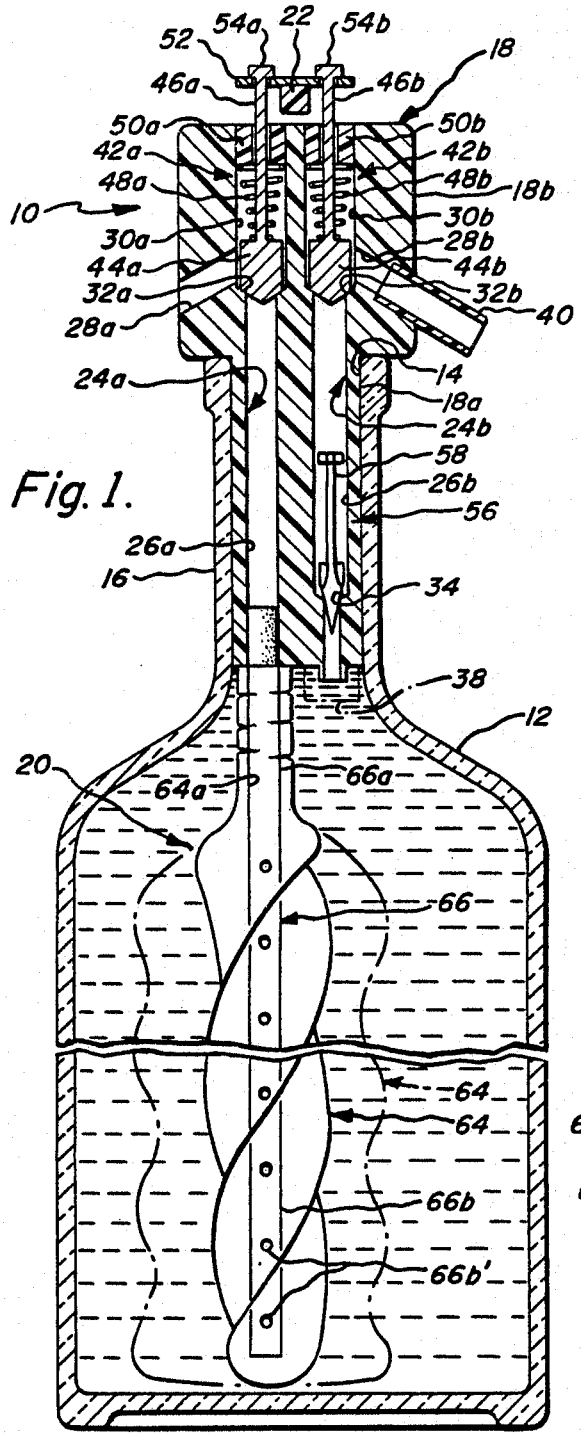
FIG. 1 is a vertical sectional view showing the present dispenser in association with a wine bottle.

A dispenser formed in accordance with a preferred form of the present invention is designated as 10 in FIG. 1 and shown in association with a container 12, such as a wine bottle having a pour opening 14 defined by the elongated neck 16. Dispenser 10 includes a stopper or other suitable sealing device 18 for sealing pour opening 14 after the wine bottle has been unsealed, as by removing a cork, not shown; a disposable bladder 20 and a manually operable lever 22 for controlling the dispensing of wine from the bottle and the admission of fluid, such as air, to the bladder in the manner to be described.

Stopper 18 may be conveniently formed with a shank portion **18*a* sized to be slidably received within neck 16 for purposes of closing pour opening 14 and an enlarged head portion 18*b*, which serves to limit the extent of insertion of the shank portion and to provide a convenient gripping surface facilitating removal of the stopper for reuse. Shank portion 18*a* may be sized to provide a fluid seal with the interior surface of neck 16 or a separate seal element, such as an O-ring, not shown, may be carried by the shank portion for this purpose. Alternatively, a seal may be created outwardly of neck 16 by a suitable flange type sealing device arranged to depend from head portion 18*b***.

Stopper 18 is formed to define first and second generally L-shaped passageways **24*a* and 24*b*, which include first sections 26*a* and 26*b* arranged to extend lengthwise of shank portion 18*a* and second sections 28*a* and 28*b* arranged to extend transversely of head portion 18*b* in opposite directions from adjacent junctures thereof with the first sections, which are defined by enlarged valve chambers 30*a* and 30*b*. Second section 28*a* defines an inlet end for placing passageway 24*a* in flow communication with a source of fluid, such as the atmosphere, and first section 26*a* defines an outlet end for placing the passageway in flow communication with bladder 20. First section 26*b* defines an inlet end for placing passageway 24*b* in flow communication with the interior of bottle 12 and second section 28*b* defines an outlet end for the passageway through which liquid may be poured. Valve chambers 30*a* and 30*b* are shown in FIG. 1 as being transversely enlarged relative to first sections 26*a* and 26*b* in order to define valve seats 32*a* and 32*b*, which face towards the valve chambers and are disposed concentrically of such first sections. First section 26*b* is also shown in FIG. 1 as being of stepped diameter so as to define a valve seat 34 arranged to face towards valve chamber 30*b***.

If desired, the inlet end of passageway **24*a* may be coupled to a source of fluid under pressure, such as may for example be defined by a ball type manual air pump, not shown; the inlet end of passageway 24*b* may be fitted with a suitable liquid strainer device, shown in broken line at 38; and the outlet end of passageway 24*b* may be fitted with a suitable pour spout 40**.

Valve seats **32*a* and 32*b* comprise parts of like constructed fluid flow and liquid pour control valves 42*a* and 42*b*, which additionally include valve members 44*a* and 44*b* carried by valve stems 46*a* and 46*b* and coil springs 48*a* and 48*b* serving to normally bias valve members 44*a* and 44*b* into fluid sealing or seating engagement with valve seats 32*a* and 32*b*, respectively. Bearing sleeves 50*a* and 50*b*, which are suitably fixed to head portion 18*b* within the outer ends of valve chambers 30a and 30b, serve to slidably support valve stems 46a and 46b and define abutment surfaces for springs 48a and 48b. The outer ends of valve stems 46a and 46b project outwardly of head portion 18b; such outer ends slidably extending through an apertured cross or tie member 52 and being fitted with enlarged ends 54a and 54b arranged for overlying engagement with such cross member. Preferably, spring 48a is formed weaker than spring 48b to permit unseating of valve member 44a before valve member 44b** upon the occurrence of an above normal bottle storage temperature sufficient to effect expansion/vaporization of liquid stored in the bottle.

Valve seat 34 comprises a part of a check valve 56 additionally comprising a weighted valve member 58, which is adapted to normally fluid seal or seat against valve seat 34 when bottle 12 is in an upright or standing position. Valve member 58 is free to slide within first section 26b under the influence of gravity to permit unseating thereof when bottle 12 is inverted, i.e. tilted sufficiently to permit the pouring of the liquid contents of the bottle through pour spout 40 in the manner to be described. It will be understood that valve member 58 is shaped to permit the flow of liquid lengthwise thereof when same is unseated relative to valve seat 34.

Figure 3:
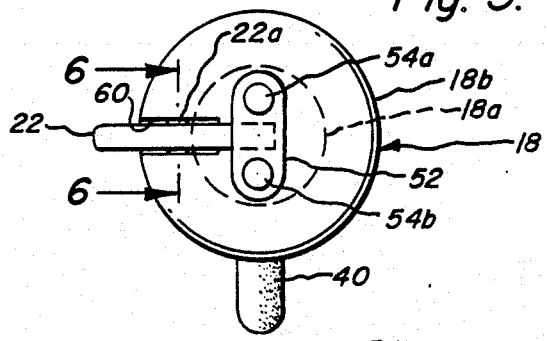
FIG. 3 is a top plan view of the dispenser.
Figure 2:
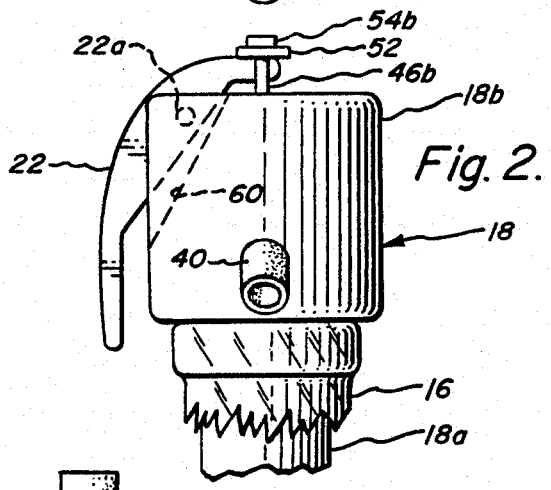
FIG. 2 is a partial side elevational view of the dispenser.
Figure 6:
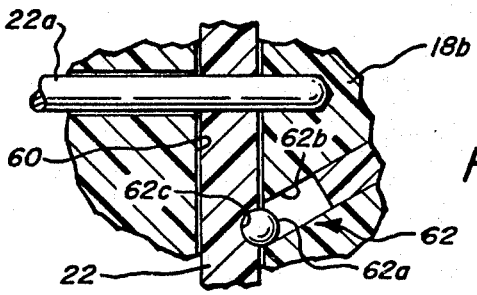
FIG. 6 is an enlarged sectional view taken generally along the line 6—6 in FIG. 2.

By now referring to FIGS. 2, 3 and 6, it will be understood that lever 22 is pivotably supported intermediate its ends by head portion 18b via a pivot pin 22a disposed to extend transversely of a vertically/transversely opening slot 60 defined by the head portion. One end of lever 22 is arranged to underlie cross member 52, such that manual pressure directed against its opposite end serves to simultaneously unseat valve members 44a and 44b against the bias of springs 48a and 48b. Preferably, head portion 18b is provided with suitable latch means, such as that generally designated as 62 in FIG. 6, which serves to prevent operation of lever 22 and the unseating of valve members 44a and 44b, except when bottle 12 is in an inverted position. Latch means 62 may be conveniently defined by a weighted ball 62a, which is slidably/rollably supported within an inclined bore opening 52b and adapted to be removably received within a latch recess 62c formed in lever 22. As will be apparent, bore opening 62b is disposed to insure that ball 62a is maintained in latching engagement within latch recess 62c to prevent operation lever 22 until bottle 12 is inverted for pouring purposes.

Figure 5:
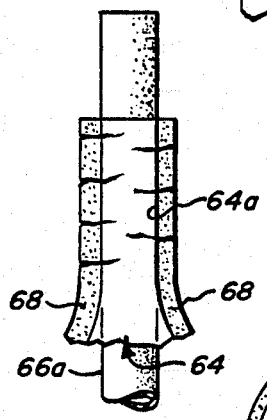
FIG. 5 is an enlarged view of the neck area of the bladder.
Figure 4:
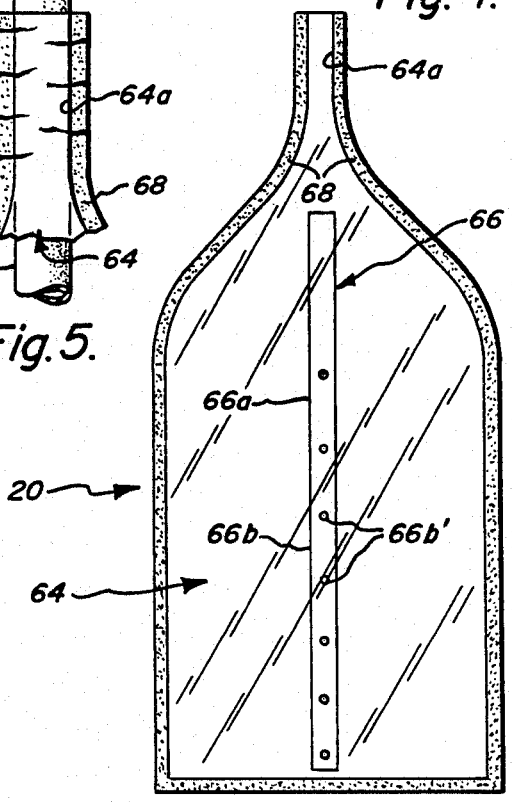
FIG. 4 is a plan view of a disposable bladder adapted for use with the present dispenser.

Bladder 20 is shown in FIGS. 1, 4 and 5 as being defined by a bag 64 having a single mouth or opening 64a and a tube 66 having a solid walled or non-apertured first section 66a and an apertured wall section 66b having a plurality of apertures 66b' uniformly distributed throughout its length. In use of bladder 20, solid walled section 66a extends through mouth 64a in a fluid sealed relationship with bag 64 and has its free, open end removably/slidably received within first section 26a of passageway 24a in a fluid sealed relationship with stopper shank portion 18a, and apertured wall section 66b is disposed wholly within the confines of bag 64, so as to place the interior of the bag in flow communication with the atmosphere or other source of fluid whenever valve member 44a is in an unseated condition. While wall section 66b is apertured due to its preferably being formed by cutting tube 66 to size from a length of tubular stock material to define an open end for such wall section, it is preferable to form this wall section with additional apertures 66b', so as to insure unimpeded flow of air into and out of bag 64.

Bag 64 is preferably formed from a pliable, fluid impermeable film of a plastic material, such as one mil polyethylene, which is inexpensive and easily fabricated to form the bag and compatible with the liquid contents of bottle 12. However, a problem with the use of polyethylene is the difficulty/expense of creating a fluid seal between tube 66 and that portion of the bag bounding mouth 64a. In this respect, the nature of polyethylene does not allow the use of inexpensive adhesive bonding procedures. Also, thermal bonding procedures are mechanically complicated and require the bag and tube to be formed of thermally compatible materials and the use of mechanically clamping devices would greatly increase the cost of manufacturing the bladder.

In accordance with the present invention, the problem of forming a fluid seal between bag 64 and tube 66 is both greatly simplified and rendered less expensive by an improved method of manufacturing bladder 20, which generally comprises assembling the bag and tube in a novel manner and then relying upon the resilient properties of the bag forming material to create a fluid seal therebetween. By referring to FIGS. 4 and 5, it will be understood that the method contemplates forming bag 64 by any suitable procedure, such as by marginally edge joining a pair of overlaid film sheets, as indicated by thermal weld area 68, to define mouth 64a of some given cross-sectional area less than the cross-sectional area of tube 64, as an incident to which the tube is wholly enclosed within the bag with its solid wall section 66a arranged to permit alignment thereof with mouth 64a. When a bag is formed flatwise, as described above, the original configuration of mouth 64a is essentially that of a slit or narrow opening whose width is typically essentially equal to or greater than the external diameter of tube 66, and as such has little or no cross-sectional area. Thus, the term as-formed cross-sectional area of mouth 64a, as used herein, is meant to include the cross-sectional area of the mouth, which it is capable of assuming when the bag forming material bounding the mouth is deformed to assume a configuration corresponding generally to that of the tube without stretching of such material, as well as the actual cross-sectional area of a mouth, which might be formed in an open condition by a bag forming procedure other than that described.

If desired, completed bladder 20 may be marketed in the form shown in FIG. 4, such bladders being merely stacked or laid flatwise within a suitable shipping box or rolled or folded upon themselves before being packaged.

When it is desired to place bladder 20 in use, the mouth end of bag 64 is gripped with one hand, while the other hand manipulates tube 66 as required to align the free end of solid walled section 66a with mouth 64a and then to force such free end outwardly through the mouth into a position arranged exteriorly of the bag, as indicated in FIG. 5; the inner walls of the bag, which converge towards the mouth, serving to create a natural funnel or guide for the end of the tube. The forcing of solid walled section 66a through mouth 64a erves to stretch the bag material bounding the mouth, such that the mouth assumes the cross-sectional area and size of the solid walled section and a fluid seal is thereby created between the bag and tube. When polyethylene film is employed in forming bag 64, only a slight stretching of the bag material bounding the mouth is required to provide a desired seal. It is not necessary that the bag forming material be resiliently deformable to any great extent, so long as such material is capable of undergoing the required degree of stretch necessary to increase the as-formed cross-sectional area of mouth 64a to that of tube 66 and as a result exert some limited contraction force tending to thereafter retain the bag and tube in frictional/fluid sealing engagement. The size of bag chosen for use should normally be sufficient to be capable of at least substantially filling bottle 12 when fully expanded by the introduction of air thereinto. In the preferred construction, wherein air at atmospheric pressure is introduced into bag 64, the bag may be formed of film material having slight resilient properties in which case the as-formed size of the bag would typically be essentially equal to or perhaps slightly larger than the interior volume of bottle 12. On the other hand, a smaller size bag formed of material possessing substantial resilient properties, may be employed, it if is desired to apply air at greater than atmospheric pressure to the bag, such as by means of a manually operable pump.

The forming of bladder 20 in the manner described possesses two advantages over and above the creation of a required fluid seal between bag 64 and tube 66, namely, the convenience to a user in operationally assembling the bag and tube, since it has been found to be extremely difficult to insert the tube into mouth 64a from a position exteriorly of the bag, and the convenience to the user of purchasing a "one-piece" bladder unit, as opposed to two physically separate articles which may become unintentionally separated/lost.

In operation, a user of dispenser 10 would first associate bladder 20 with stopper 18 by slide fitting the projecting end of tube 66 within first section 26a of passageway 24a, and then after bottle 12 is unsealed, "bunch up" bag 64 to lie sufficiently close to the tube, as will permit insertion of the bladder inwardly through bottle pour opening 14, and finally force shank portion 18a into neck 16 to create a fluid seal between the stopper and the bottle and position the bladder within the confines of the bottle. Incident to this assembly procedure, air overlying the bottle contents, as a result of the initial unsealing of the bottle, is displaced for flow, together with possibly a small quantity of the liquid contents of the bottle, into first section 26b and preferably upwardly past check valve 56, such that the interior of the bottle is occupied solely by bladder 20 and liquid to be dispensed. Air and any liquid trapped within passageway 24b between check valve 56 and pour control valve 42b will be discharged when bottle 12 is subsequently tilted or inverted for pouring purposes and the pour control valve forced to open position.

When it is desired to pour liquid from bottle 12, the bottle is first inverted to effect unlatching of latch means 62 and then lever 22 depressed for purposes of opening valves 42a and 42b. When a desired quantity of liquid has been poured, lever 22 is released to permit closure of valves 42a and 42b and bottle 12 returned to its normal upright position, whereupon latch means 62 is again rendered operable for lever latching purposes. Placement of valve 42b in close proximity to the outlet end of passageway 24b and the slight downward inclination of second section 28b insures that no liquid is retained within such passageway after valve 42b is closed and bottle 12 returned to upright position, which is exposed to the atmosphere. Check valve 34 automatically opens and closes under the influence of gravity incident to movement of bottle 12 between upright and inverted positions; such valve insuring against backflow of liquid and air into the bottle in the event that the bottle is returned to its upright position prior to closing of valve 42b.

As an incident to the pouring of liquid from the bottle, its liquid content is reduced, and as a result, air pressure acting within bladder 20, due to the concurrent opening of valve 42a, serves to unfold/expand bag 64 to a volume equal to the volume of liquid dispensed. If, during subsequent storage of bottle 12, storage temperature should tend to increase the vapor pressure of its liquid contents, bag 64 will tend to partially collapse and force air outwardly through valve 42a in order to prevent possible damage to the bottle or the unseating of stopper 18. After bottle 12 is emptied of liquid, stopper 18 may be removed and appropriately cleaned prior to re-use and bladder 20 discarded and replaced by a fresh bladder, if desired.

As will be apparent, dispenser 10 will function if valve 42a is dispensed with, but the provision of this valve is preferred in that it prevents escape of air from bladder 20 under normal storage temperatures and as a result prevents the possibility of any backflow of liquid/air into bottle 12 in the event valve 42b and/or valve 34 should leak.

What is claimed is:

1. A dispenser for controlling the dispensing of a liquid from a container having an opening through which liquid may be poured and preventing air contamination of liquid remaining within said container, said dispenser comprising:

stopper means removably attachable to said container for creating a fluid seal about said opening, said stopper means having first and second passageways extending therethrough, said first passageway having an inlet end arranged to be positioned exteriorly of said container for communication with a source of fluid and an outlet end arranged to be positioned interiorly of said container for communication with the interior thereof, said second passageway having an inlet end arranged to be positioned interiorly of said container for flow communication with said interior thereof and an outlet end arranged to be positioned exteriorly of said container for communication with the atmosphere;

a fluid impermeable bladder having the interior thereof attachable to said outlet end of said first passageway and capable of expanding to a volume at least essentially corresponding to the volume of said interior of said container;

a liquid pour control valve operable to permit pouring of liquid from said container through said outlet end of said second passageway when said container is placed in an inverted condition;

a fluid flow control valve operable to permit flow of fluid from said source of fluid to said interior of said bladder to permit expansion of said bladder to occupy a volume of said interior of said container corresponding to a volume of fluid poured therefrom; and a check valve arranged in said second passageway adjacent said inlet end for blocking flow communication between said inlet and outlet ends of said second passageway when said container is placed in an upright condition, said liquid pour and fluid flow control valves each include a valve seat, a valve member and spring means for biasing said valve member into seated, fluid sealing engagement with said valve seat, and said control valves include a common manually operable means for simultaneously unseating the valve members thereof; and said stopper means includes gravity operated latch means operable when said container is in an upright condition for preventing operation of said manually operable means to unseat said valve members.

2. A dispenser for controlling the dispensing of a liquid from a container having an opening through which liquid may be poured and preventing air contamination of liquid remaining within said container, said dispenser comprising:

stopper means removably attachable to said container for creating a fluid seal about said opening, said stopper means having first and second passageways extending therethrough, said first passageway having an inlet end arranged to be positioned exteriorly of said container for communication with a source of fluid and an outlet end arranged to be positioned interiorly of said container for communication with the interior thereof, said second passageway having an inlet end arranged to be positioned interiorly of said container for flow communication with said interior thereof and an outlet end arranged to be positioned exteriorly of said container for communication with the atmosphere;

a fluid impermeable bladder having the interior thereof attachable to said outlet end of said first passageway and capable of expanding to a volume at least essentially corresponding to the volume of said interior of said container;

a liquid pour control valve operable to permit pouring of liquid from said container through said outlet end of said second passageway when said container is placed in an inverted condition;

a fluid flow control valve operable to permit flow of fluid from said source of fluid to said interior of said bladder to permit expansion of said bladder to occupy a volume of said interior of said container corresponding to a volume of fluid poured therefrom; and a check valve arranged in said second passageway adjacent said inlet end for blocking flow communication between said inlet and outlet ends of said second passageway when said container is placed in an upright condition, said first and second passageways have adjacently disposed inner sections extending lengthwise of said cap means and outer sections disposed to extend transversely of said cap means and in opposite directions from adjacent the junctures thereof with said inner sections, said liquid pour and fluid flow control valves have valve seats bounding said inner sections and facing in a common direction towards said junctures, valve members for each of said valve seats, means supporting said valve members for parallel reciprocating movement into and out of fluid sealing seated engagement with said valve seats, independent spring means tending to bias said valve members into seated engagement with their valve seats, a manually operable lever pivotally supported by said stopper means, and connecting means connecting said lever to each of said valve members for moving said valve members away from their valve seats against said bias incident to pivotal movement of said lever between valve closed and open positions thereof, said connecting means permitting movement of said valve member of at least said fluid flow control valve away from its valve seat and relative to said lever when said lever is in said valve closed position and said spring means tending to bias said valve member of said fluid flow control valve being weaker than said spring means tending to bias said valve member of said liquid pour control valve.

3. A dispenser according to claim 2, wherein said stopper means includes gravity operated latch means operable to prevent movement of said lever from said valve closed position into said valve open position when said container is in an upright condition.

4. A disposable bladder adapted to be inserted into a container and expanded therewithin for preventing air contamination of liquid contained within said container, said bladder comprising:

a bag formed of pliable, fluid impermeable film material shaped to define a single mouth opening communicating with the interior thereof, said mouth opening having a given as-formed cross-sectional area, and at least that portion of said material bounding said mouth opening being resiliently deformable sufficiently to permit said mouth opening to be expanded to assume a second cross-sectional area exceeding said as-formed cross-sectional area; and a flow tube disposed wholly within said interior of said bag, said tube having an open ended, solid walled first section and an apertured walled second section disposed in flow communication with said first section, said flow tube is arranged within said bag to permit placement of said first section to extend outwardly through said mouth, while said second section remains wholly within said interior of said bag, and said first section has a cross-sectional area corresponding to said second cross-sectional area.

5. A method of forming a disposable bladder comprising the steps of:

providing a tube having a lengthwise section thereof formed of solid walled construction, said solid walled section having a given cross-sectional area; and forming a bag having its interior wholly enclosing said tube and a single mouth opening communicating with said interior and arranged relative to said tube to permit insertion of said solid walled section thereinto, said mouth having an as-formed cross-sectional area less than said given cross-sectional area, and said bag being formed from a pliable, fluid impermeable material having sufficient resiliency to permit the cross-sectional area of said mouth to be expanded to assume said given cross-sectional area upon insertion of said solid walled section thereinto.

* * * * *

UNITED STATES PATENT AND TRADEMARK OFFICE

CERTIFICATE OF CORRECTION

PATENT NO. : 4,809,884

DATED : March 7, 1989

INVENTOR(S) : Wells F. Stackhouse

It is certified that error appears in the above-identified patent and that said Letters Patent is hereby corrected as shown below:

Col. 3, line 42 - "52b" should be --62b--.

Col. 3, line 46 - after "operation", insert --of--.

Col. 4, line 60 - "erves" should be --serves--.

Col. 5, line 17 - "it if" should be --if it--.

Col. 6, line 57 - "fluid" should be --liquid--.

Col. 7, line 39 - "fluid" should be --liquid--.

Signed and Sealed this

Fifth Day of December, 1989

*Attest:*

JEFFREY M. SAMUELS

*Attesting Officer*

*Acting Commissioner of Patents and Trademarks*